United States Patent [19]

Jacobs

[11] Patent Number: 4,934,621

[45] Date of Patent: Jun. 19, 1990

[54] DEVICE FOR CONTINUOUSLY FEEDING A WEB OF MATERIAL FROM A STOCK ROLL

[75] Inventor: Thomas G. M. Jacobs, Boxmeer, Netherlands

[73] Assignee: Stork Contiweb B.V., Boxmeer, Netherlands

[21] Appl. No.: 255,114

[22] Filed: Oct. 7, 1988

[30] Foreign Application Priority Data

Oct. 9, 1987 [NL] Netherlands ..... 8702407

[51] Int. Cl.[5] ..... B65H 19/18; B65H 19/20

[52] U.S. Cl. ..... 242/58.3

[58] Field of Search ..... 242/58.3, 58.2, 58.1, 242/58

[56] References Cited

U.S. PATENT DOCUMENTS

| | | | |
|---|---|---|---|
| 1,828,297 | 10/1931 | Schmidt | 242/58.2 |
| 2,005,037 | 6/1935 | Johancen et al. | 242/58.3 |
| 2,047,713 | 7/1936 | Wood . | |
| 2,638,281 | 5/1953 | Tollison et al. . | |
| 3,309,036 | 3/1967 | Anderson | 242/58.3 |
| 4,132,371 | 1/1979 | Byrt | 242/58.3 |
| 4,165,842 | 8/1979 | Mengel | 242/58.3 |
| 4,673,142 | 6/1987 | Keene et al. | 242/58.3 |
| 4,729,522 | 3/1988 | Tafel et al. | 242/58.3 X |
| 4,763,851 | 8/1988 | Flament | 242/58.3 |

FOREIGN PATENT DOCUMENTS

| | | |
|---|---|---|
| 2118984 | 11/1972 | Fed. Rep. of Germany . |
| 3530919 | 4/1975 | Fed. Rep. of Germany . |
| 1347701 | 11/1963 | France . |
| 6403872 | 4/1963 | Netherlands . |
| 1326734 | 8/1973 | United Kingdom . |

OTHER PUBLICATIONS

Research Disclosure, No. 143, 3/1976, pp. 45-46, Abstract No. 14360, "Automatic Loading Unwind Stand for Cutting and Splicing Thermplastic Sheet Material".

*Primary Examiner*—John M. Jillions
*Attorney, Agent, or Firm*—Michael N. Meller

[57] ABSTRACT

In a device for continuously feeding a web of material from a stock roll, a conveyor means for conveying the unwinding roll and the remnant roll through the device comprise two parallel essentially U-shaped guide tracks for the rolls. The legs of the U extend in lengthwise direction of the device, such that both loading of a new roll and picking up and discharging of a remnant roll can take place at the front side of the device. For controlling the speed of an unwinding roll two driving belt units are provided which can cooperate with the periphery of the unwinding roll one after another. For running a new roll up to the required peripheral speed for making a splice with an unwinding web and keeping said roll at that speed until the splice is made a core drive is provided which acts upon the shaft of the new roll, and which can work independently of the driving belt units. A new roll can thus be prepared with an adhesive strip over the whole width of the roll, which will result in an uninterrupted splice. The device is further provided with a new web splicing unit.

7 Claims, 17 Drawing Sheets

DEVICE FOR CONTINUOUSLY FEEDING A WEB OF MATERIAL FROM A STOCK ROLL

BACKGROUND OF THE INVENTION

The invention relates to a device for continuously feeding a web of material from a stock roll, comprising a frame, means for rotatably supporting an unwinding stock roll which is present in the device and off which the web of material is coming, means for rotatably supporting a new stock roll placed in the device, means for controlling the peripheral speed of the unwinding roll, means for driving the new roll, and means for adhering the leading end of the web on the new roll to the unwinding web coming off the unwinding roll and severing the unwinding web after the splicing point.

Such a device is known in various embodiments.

In one of the known devices of this type there is a conveyor track for the rolls which runs through the device from front to back. Under this conveyor track are two driving belt units for driving rolls supported by the conveyor track. Each driving belt unit comprises a flat driving belt running round a drive roller and an idler roller. The drive rollers of the two driving belt units are on the bottom side of the device, disposed in the lengthwise direction of the device at some distance from each other. The drive rollers can be driven jointly. Each driving belt unit can be swung about an axis which coincides with the axis of the drive roller thereof, in such a way that the driving belt units can be moved up and down rotating about said axis. When an unwinding roll which is being driven at the periphery by one of the two driving belt units is on the conveyor track, a new roll can be placed on the conveyor track at the beginning of the conveyor track. During the unrolling of the unwinding roll a conveyor belt of the conveyor track moves towards the back, while the periphery of the unwinding roll always remains in contact with the belt of the first driving belt unit, which swings further and further downwards. When the unwinding roll has reached a minimum diameter and a splice has to be made between the leading end of the prepared new roll and the unwinding web, the second driving belt unit is brought into contact with the periphery of the new roll, so that the new roll is run up to speed. The two driving belt units are then driven jointly, so that the two driving belts are running at the same speed. When the unwinding roll and the new roll have reached the same peripheral speed, a splice is made between the leading end of the new roll and the unwinding web, and the unwinding web is severed after the splice point. The first driving belt unit is also moved out of contact with the periphery of the roll which has had the web severed so that this roll is no longer driven. The new roll has now become the unwinding roll which is driven by the second driving belt unit, and the old roll is now a remnant roll. On further movement of the conveyor belt of the conveyor track towards the back, the remnant roll is discharged at the back of the device, while the unwinding roll moves further towards the back. At a certain point in time the drive of the unwinding roller is taken over again by the first driving belt unit, and the second driving belt unit is moved out of contact with the unwinding roll. Thereafter a new roll can be placed again on the conveyor track, and the cycle can be repeated. The web tension of the unwinding web is regulated by means of a dancer during the entire unwinding process.

In another known device of the above-mentioned type, which is described in European Patent Specification No. 0.005.021, there is also a conveyor track running from front to back through the device for conveying the unwinding roll and the new roll through the device. There is, however, only one driving belt unit, which is situated below the conveyor track for the rolls. The driving belt unit here also has a flat driving belt running round a drive roller and an idler roller. The driving belt unit slopes upwards in the direction of movement of the conveyor belt of the conveyor track and can thereby swing about an axis of rotation which coincides with the axis of the drive roller, which is situated on the low side of the driving belt unit, and is itself adjustable in height. When the unwinding roll is being unwound, a new roll can be placed at the beginning of the conveyor belt. During the unwinding of the unwinding roll the conveyor belt of the conveyor track moves towards the back. As the diameter of the unwinding roll becomes smaller, the belt of the driving belt unit resting against the periphery of the unwinding roll moves upwards. At a particular diameter of the unwinding roll, the driving belt comes into contact with the new roll lying on the conveyor track, and said roll thereby runs up to speed and reaches the same peripheral speed as the unwinding roll. At a particular minimum diameter of the unwinding roll a splice is made—in the same way as that described for the above-mentioned known device—between the leading end of the web on the new roll and the unwinding web, and the unwinding web is severed. The new roll has now become the unwinding roll. The conveyor belt of the conveyor track now moves further towards the back, so that the remnant roll can be discharged at the rear of the device. The new unwinding roll also moves towards the back, the periphery of this roll always remaining in contact with the driving belt. At a particular position of the new unwinding roll a new roll can be placed again at the beginning of the conveyor track, and the entire cycle can be repeated.

The above-described known devices have the following disadvantages. The remnant roll is deposited at the rear side of the device, so that there is little room for picking up and removing the deposited remnant roll. The remnant roll therefore has to be removed from the side. Another disadvantage is that the new roll is driven at the periphery by a driving belt, which means that a certain part of the leading end of the new roll has to remain free from adhesive. This requires extra care during the preparation of a new roll. It also means that an uninterrupted splice between the leading end of the new roll and the unwinding web is not possible over the width of the web, which is a disadvantage, in view of the impact of air during forward movement of the web.

SUMMARY OF THE INVENTION

It is the object of the present invention to provide a device of the above-mentioned type which does not have the disadvantage of the known devices.

For the elimination of the first-mentioned disadvantage, according to the invention, a device of the above-mentioned type is provided with conveyor means for conveying through the device the unwinding roll and the remnant roll, i.e. the remaining part of the unwinding roll which is left after the web coming from said roll is severed, said conveyor means comprising a first section for conveying the unwinding roll during unwinding from the front of the device towards the rear thereof, and a second section for conveying the remnant roll out of the device to the front thereof.

Through this design, it is possible both for the new roll to be placed and discharged at the front of the device. This leads to a much simpler operation of the device and provides the possibility for automation of the placing of new rolls and the discharge of remnant rolls.

For the elimination of the other disadvantage, according to the invention, in a device of the above-mentioned type the means for controlling the peripheral speed of the unwinding roll comprise a speed control element which is designed to cooperate with the periphery of the unwinding roll, and the means for driving the new roll are capable of working independently of the means for controlling the peripheral speed of the unwinding roll and comprise a driving element which is designed to act upon the shaft of the new roll.

It is possible in this way to run the new roll up to the desired peripheral speed without the new roll being driven at the periphery. This means that the leading end of the web on the new roll can be provided with an adhesive over its entire width, so that it is possible to make an uninterrupted splice over the width of the web between the leading end of the web on the new roll and the unwinding web. When the said splice has been made the drive acting upon the shaft of the new unwinding roll can be switched off and the peripheral speed of the new unwinding roll can be controlled by means of the speed control element cooperating with the periphery of the unwinding roll.

Further features and details of a device according to the invention are laid down in the dependent claims.

The invention will be explained in greater detail by means of the description below of a preferred embodiment of a device according to the invention with reference to the appended drawings.

BRIEF DESCRIPTION OF THE DRAWINGS

FIG. 1 is a side view of a particular preferred embodiment of a device according to the invention;

FIG. 3 shows a guide track for a shaft bearing an end of a roll, in a view along the line III—III in FIG. 4;

FIGS. 19 to 21 show the position of the various main parts and of the unwinding roll and the new roll in the devices according to the invention, at different stages of the unwinding process.

DETAILED DESCRIPTION OF A PREFERRED EMBODIMENT

Figure 1A:
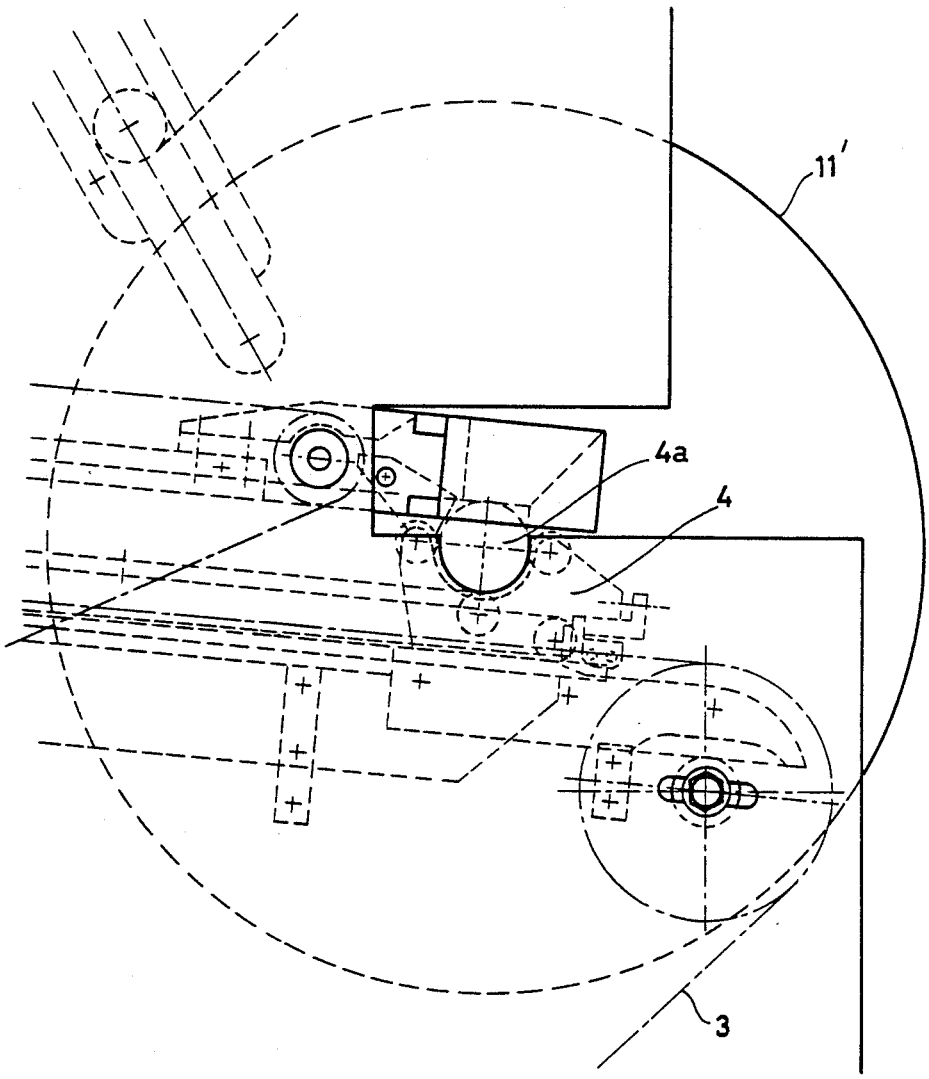
FIG. 1*a* shows a detail IA of FIG. 1 on an enlarged scale.
Figure 2:
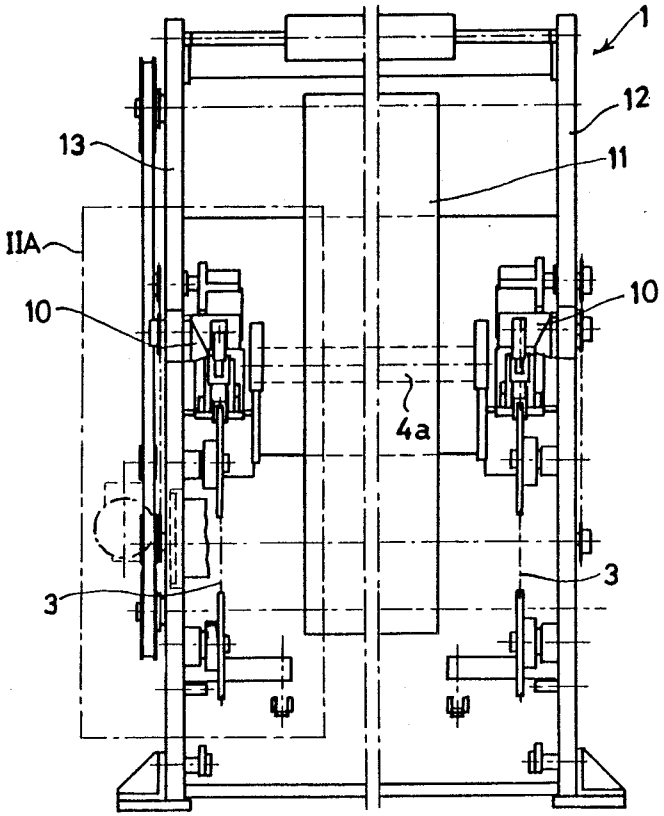
FIG. 2 shows a front view of the device of FIG. 1 in the direction of arrow II in FIG. 1.
Figure 2A:
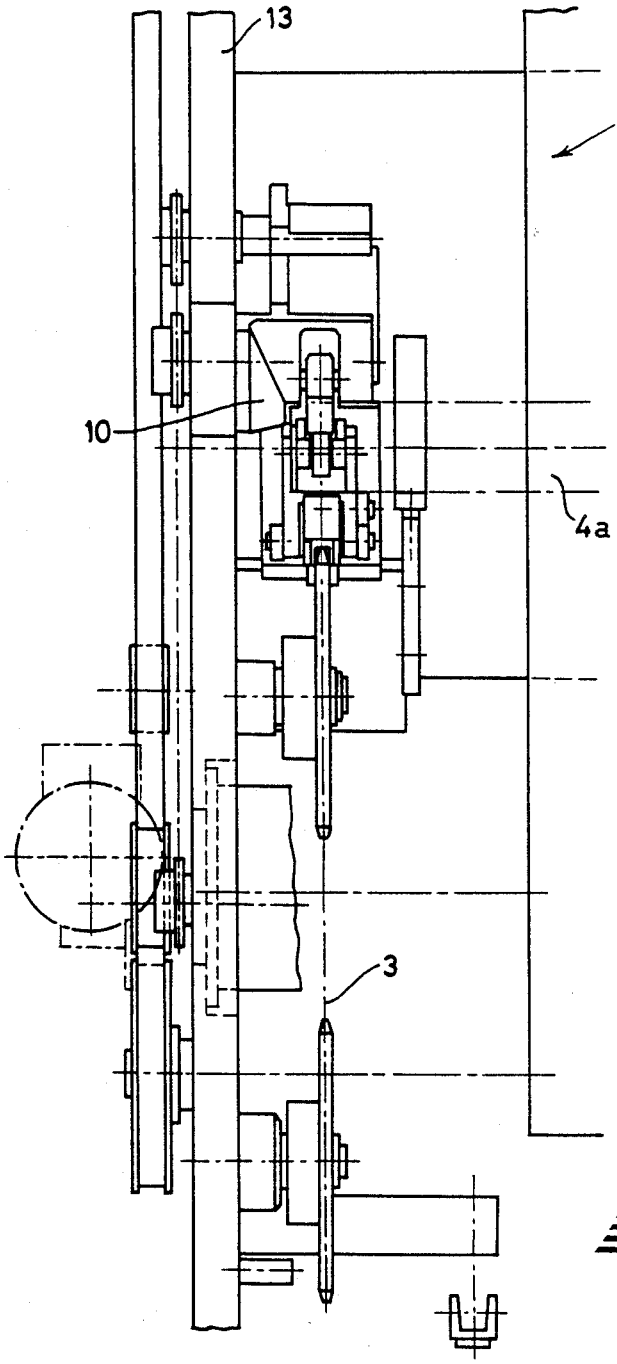
FIG. 2*a* shows a detail IIA of FIG. 2 on an enlarged scale.

The device shown in FIGS. 1 and 2 for feeding a web of material continuously from a stock roll comprises the following main parts: a frame, which is indicated in general by reference number 1, a guide device for guiding the ends of the shafts of an unwinding roll and a remnant roll through the device, said guide device being indicated in general by reference number 2, a drive device, indicated in general by reference number 3, for driving a carrier 4 for carrying along a shaft 4*a* bearing a roll, a control device for controlling the peripheral speed of an unwinding roll, which comprises a first driving belt unit 5, a second driving belt unit 6, and a common control element 7 for controlling the peripheral speed of the driving belts of the two driving belt units 5, 6, a web splicing unit indicated in general by reference number 8, a tensioning device 9 for keeping the unwinding web tensioned, and a device indicated in general by reference number 10 for adjusting the shafts of an unwinding roll and the new roll in the crosswise direction.

FIG. 1 also shows the periphery of a new roll 11 with maximum diameter and the periphery of a new roll 11' with minimum diameter. In addition, the periphery of an unwinding roll with minimum diameter is indicated by 11*a* and the unwinding web by 11*b*.

Figure 2B:
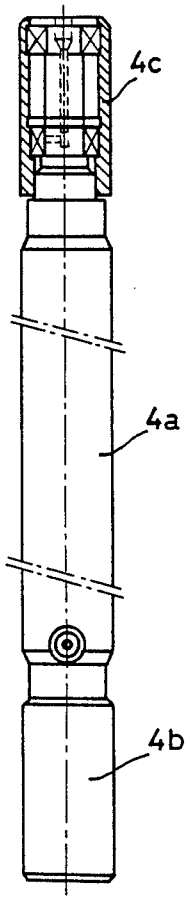
FIG. 2*b* shows a possible embodiment of a shaft for a roll, on an enlarged scale, with rotatably mounted bushes at the ends.
Figure 5:
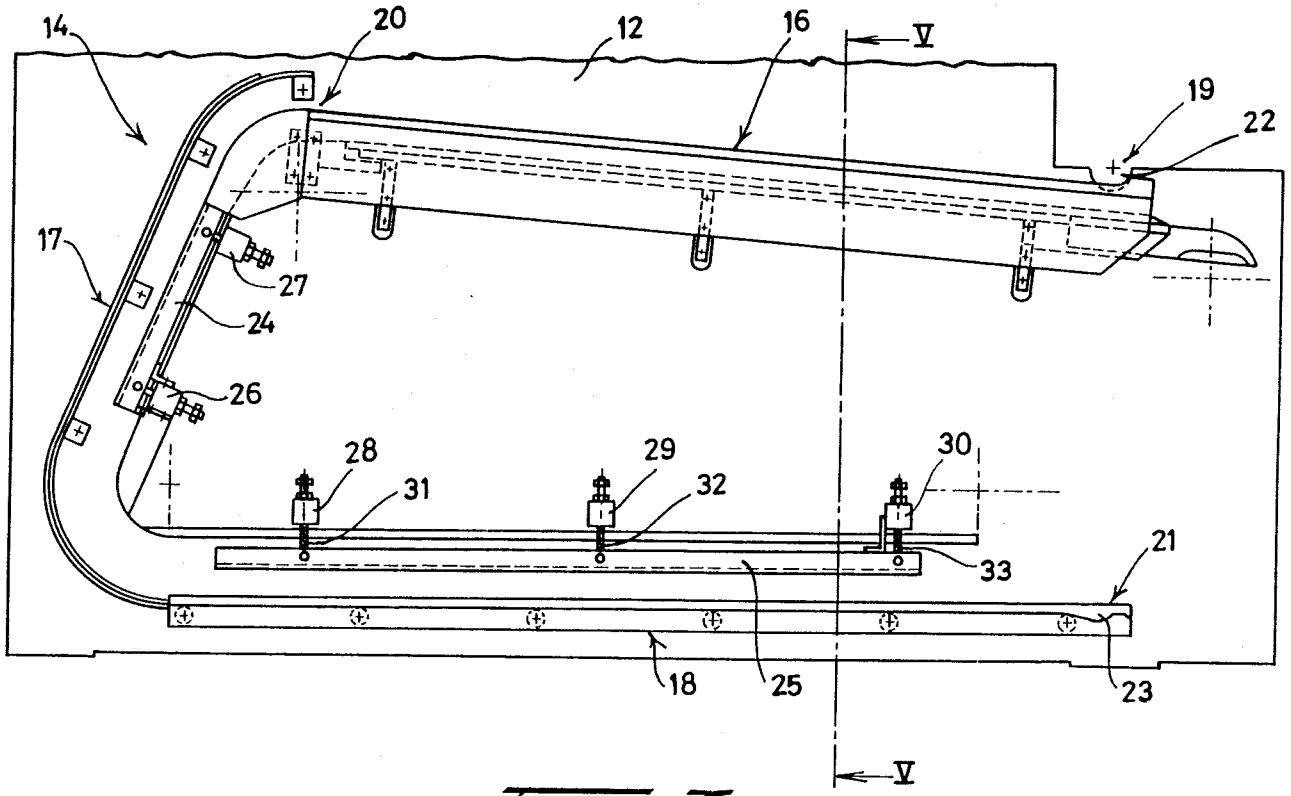

The frame 1 consists essentially of two vertical mounting plates 12 and 13, placed at a distance from each other, and between which and on which the various parts of the device are mounted. The shaft 4*a* for a roll can be provided at its end with rotatably mounted bushes 4*b* and 4*c* (FIG. 2*b*).

Figure 5:
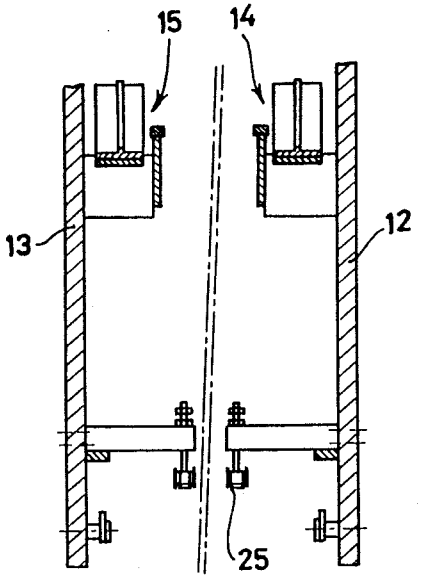
FIG. 5 is a view in cross section along the line V—V in FIG. 3.
Figure 4:
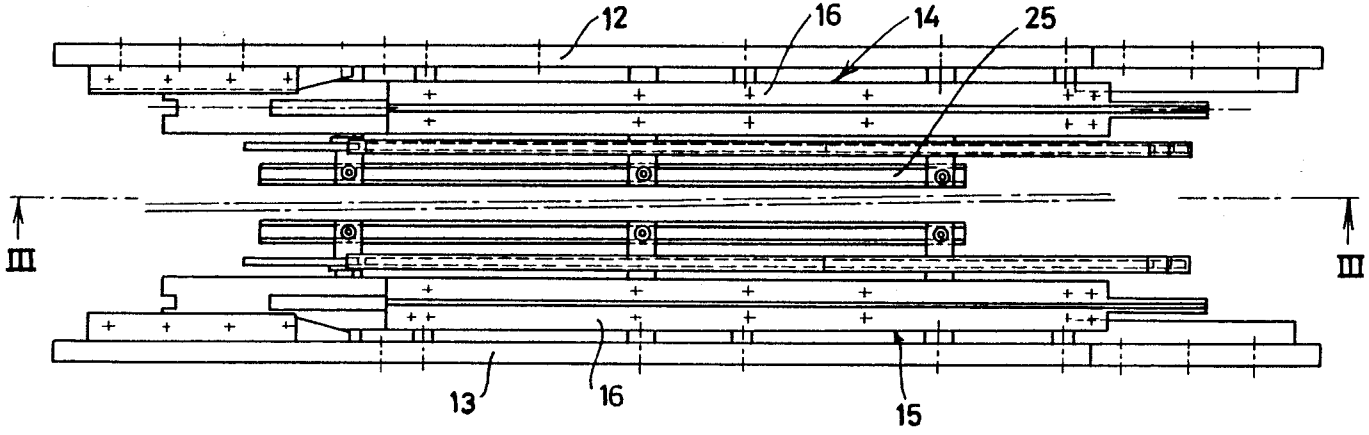
FIG. 4 is a top view of the guide tracks, one of which is shown in FIG. 3.
Figure 7:
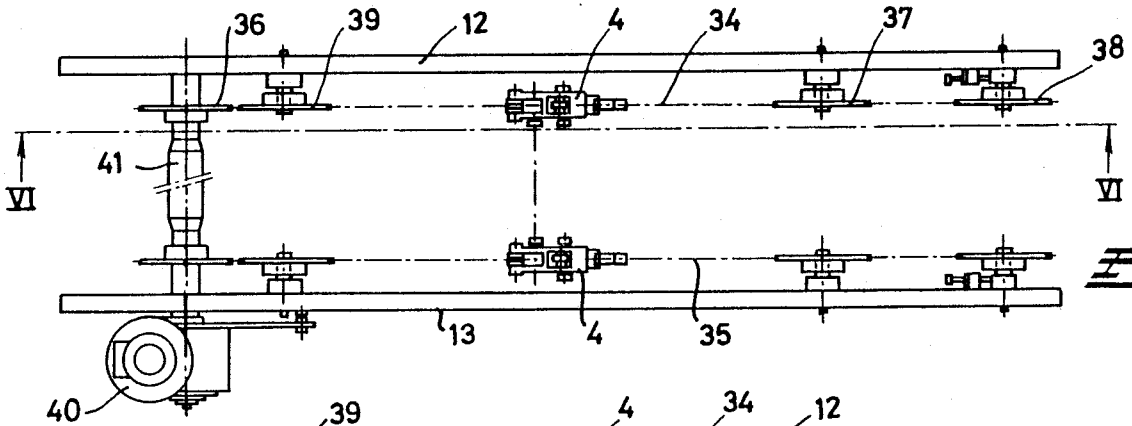

The guide device 2 comprises a set of parallel guide tracks 14 and 15, fixed to the mounting plates 12 and 13 on either side of the device (see FIGS. 3 to 5). FIG. 3 shows the guide track 14 mounted on the mounting plate 12. The guide track is essentially U-shaped in side view, and consists of an essentially horizontal top part 16, an intermediate part 17 connecting to the top part 16 and extending essentially in the vertical direction, and a bottom part 18 connecting to the intermediate part 17 and extending essentially in the horizontal direction. The top part 16 of the guide track 14 serves to guide the shaft 4*a* of an unwinding roll from an initial position indicated by 19 to an end position indicated by 20. The intermediate part 17 and the bottom part 18 connected thereto serve to guide the shaft of a remnant roll from the position indicated by 20 to the position indicated by 21 at the end of the bottom part 18 of the guide track. The top part 16 of the guide track is provided at the beginning, at the position indicated by 19, with a seat 22 to receive one end of the shaft of a new roll. The bottom part 18 is provided at the end, at the position indicated by 21, with a seat 23 to receive one end of the shaft of a remnant roll.

Elongated friction elements 24, 25, running parallel to the intermediate part 17 and the bottom part 18, are present at the intermediate part 17 and the bottom part 18 of the guide track 14. Said friction elements can cooperate with the shaft of a remnant roll in such a way that the remnant roll will rotate, causing the loose end part of the severed web to be wound onto the remnant roll. The position of the friction elements 24 and 25 can be set by means of the setting elements 26, 27 and 28, 29 and 30 respectively. Springs 31, 32 and 33 ensure that the friction element 25 is pressed with a specific force against the shaft of the remnant roll. Such springs are also present for the friction element 24 (not shown in FIG. 3).

The guide track 15 is designed in the same way as the guide track 14.

Figure 7:
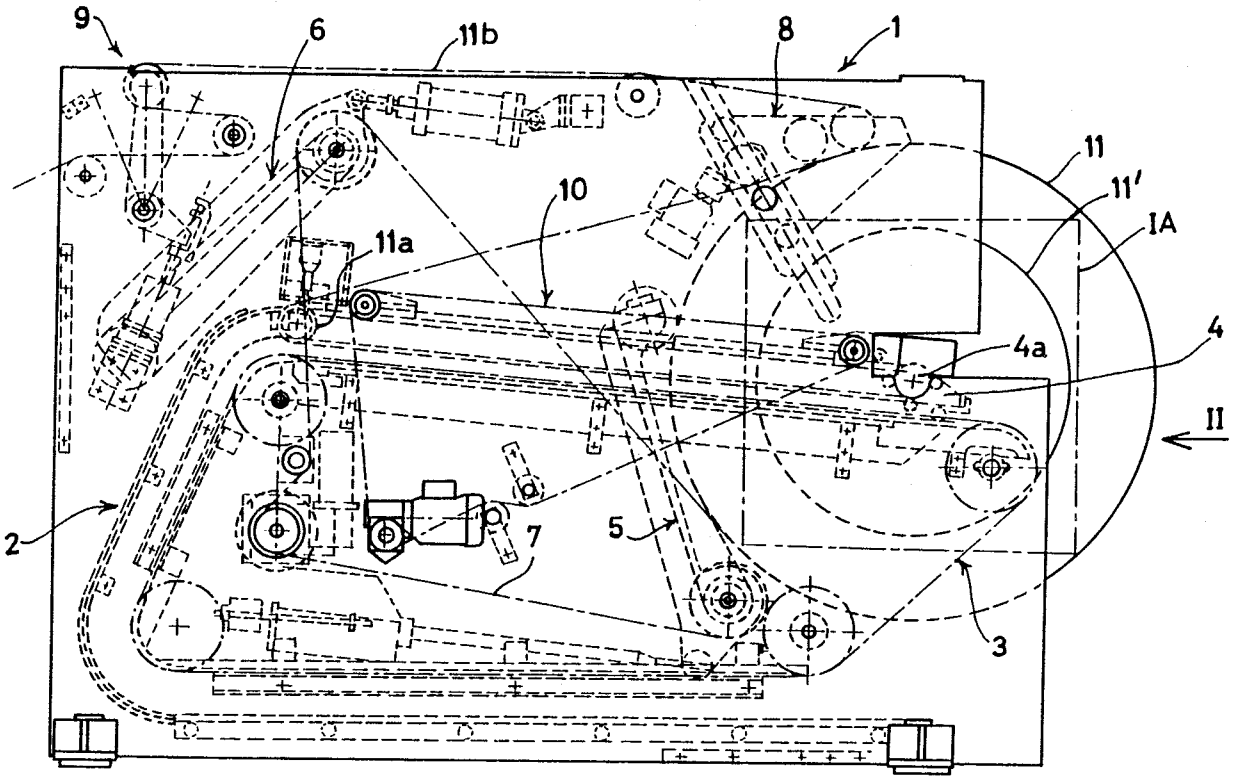
FIG. 7 is a top view of the drive of the carriers for a shaft.
Figure 6:
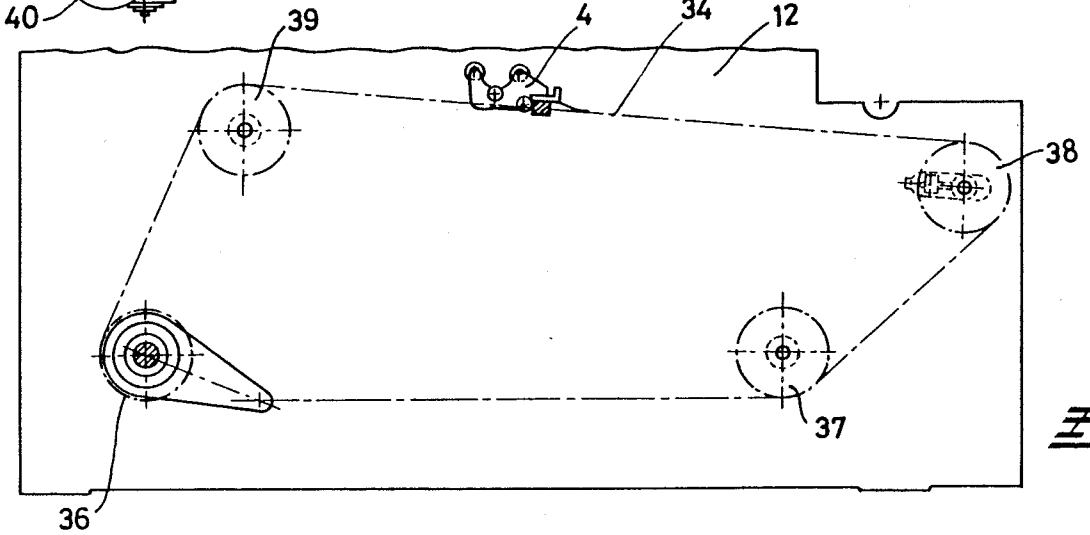
FIG. 6 shows the drive of a carrier for a shaft carrying a roll, in a view along the line VI—VI in FIG. 7.

The drive device 3 shown in FIGS. 6 and 7 for driving carrying elements 4 which carry the shaft of an unwinding roll and the shaft of a remnant roll through the guide tracks 14 and 15 comprise a set of endless conveyor chains 34 and 35 running along the two guide tracks 14 and 15. FIG. 6 shows the conveyor chain 34 running along the guide track 14. The conveyor chain is guided over sprocket wheels 36, 37, 38 and 39. The sprocket wheel 36 is the driving sprocket wheel, which in turn is driven by a motor with transmission, indicated together by 40. The sprocket wheels 37, 38 and 39 serve as idler sprocket wheels, the sprocket wheel 38 being adjustable for the purpose of tensioning the chain 34. A carrier 4 is fitted on each chain 34, 35. The sprocket wheel 36 is fixed on a driving shaft 41 driven by the motor 40. The sprocket wheels 37, 38 and 39 are rotatably fixed on the mounting plate 12. The chaindrive next to the guide track 15 is of the same design as the chain drive next to the guide track 14.

Figure 8:
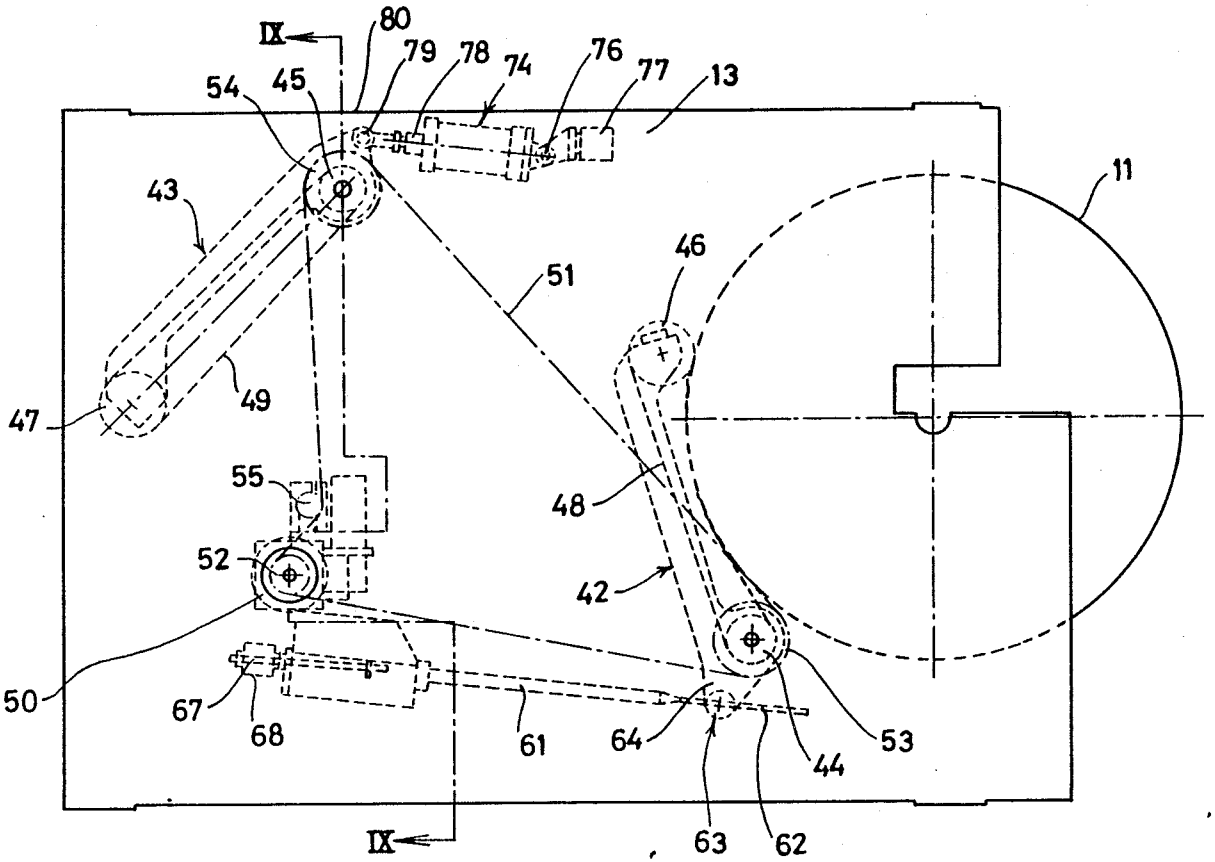
FIG. 8 is the control device for controlling the peripheral speed of the belts of the driving belt units for the unwinding roll.
Figure 9:
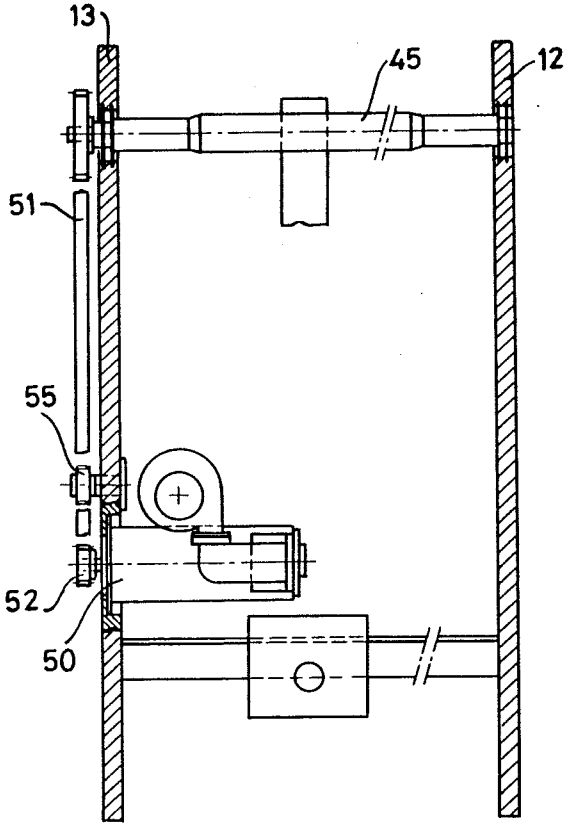
FIG. 9 is a view in cross section along the line IX—IX in FIG. 8.

The control device shown in FIGS. 8 and 9 for controlling the peripheral speed of an unwinding roll comprises a first driving belt unit 42 and a second driving belt unit 43 (FIG. 8). The driving belt units 42 and 43 are designed to cooperate with the unwinding roll after one another. The first driving belt unit 42 is intended for controlling the peripheral speed of the unwinding roll during the first part of the unwinding period, i.e. during the time that the shaft of the unwinding roll is in the position 19 on the guide tracks 14, 15 and on a part of the guide tracks connecting thereto. The second driving belt unit 43 is intended for controlling the peripheral speed of the unwinding roll during the period that the shaft of the unwinding roll is on the remaining part of the top part 16 of the guide tracks 14, 15 up to the position 20 on the guide tracks. When the shaft of the unwinding roll is at a particular place situated between the positions 19 and 20 on the guide tracks, the second driving belt unit 43 will take over the control of the peripheral speed of the unwinding roll from the first driving belt unit 42.

Figure 12:
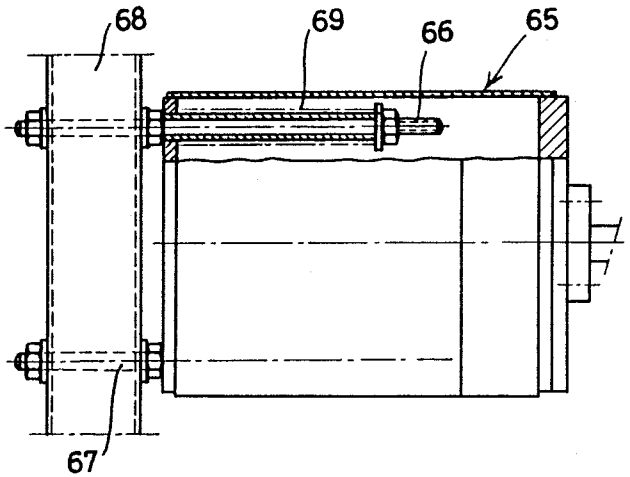
FIG. 12 is a view in the direction of the arrow XII in FIG. 10.

Each driving belt unit 42, 43 consists at least of a control roller 44, 45 respectively and an idler roller 46, 47 respectively, which are supported in the mounting plates 12 and 13 of the frame 1, and around which a flat driving belt 48, 49 respectively runs. Each driving belt unit 42, 43 can swing about an axis coinciding with the axis of the control roller 44, 45 respectively. The peripheral speed of the belts of the two driving belt units 42 an 43 is controlled by a common endless geared belt 51 cooperating with the control rollers 44, 45, the peripheral speed of said belt being controlled by a motor 50. Said geared belt 51 runs over a gear wheel 52 which is coupled directly to the motor 50, and over gear wheels 53 and 54 which are fixed to the control rollers 44 and 45 of the driving belt unit 42 and 43. There is also provided a tensioning roller 55 for tensioning the geared belt 51. The two driving belt units 42 and 43 are shown on an enlarged scale in FIGS. 10 to 12 and in FIGS. 13 and 14 respectively.

Figure 11:
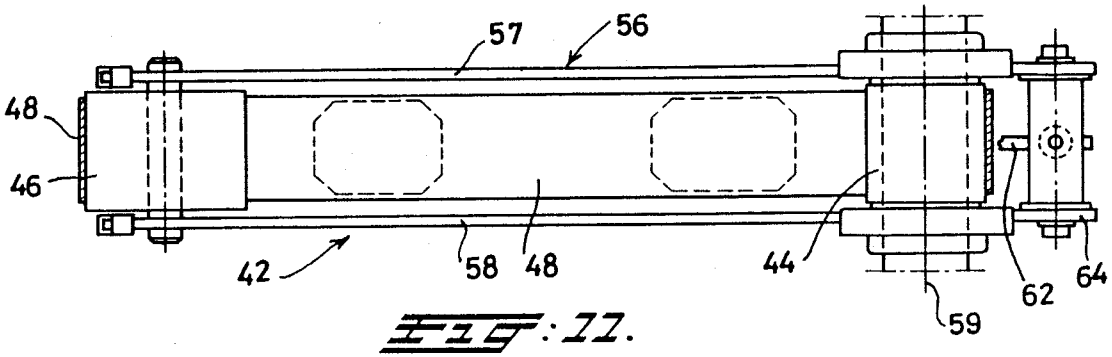
FIG. 11 is a cross section along the line XI—XI in FIG. 10.
Figure 10:
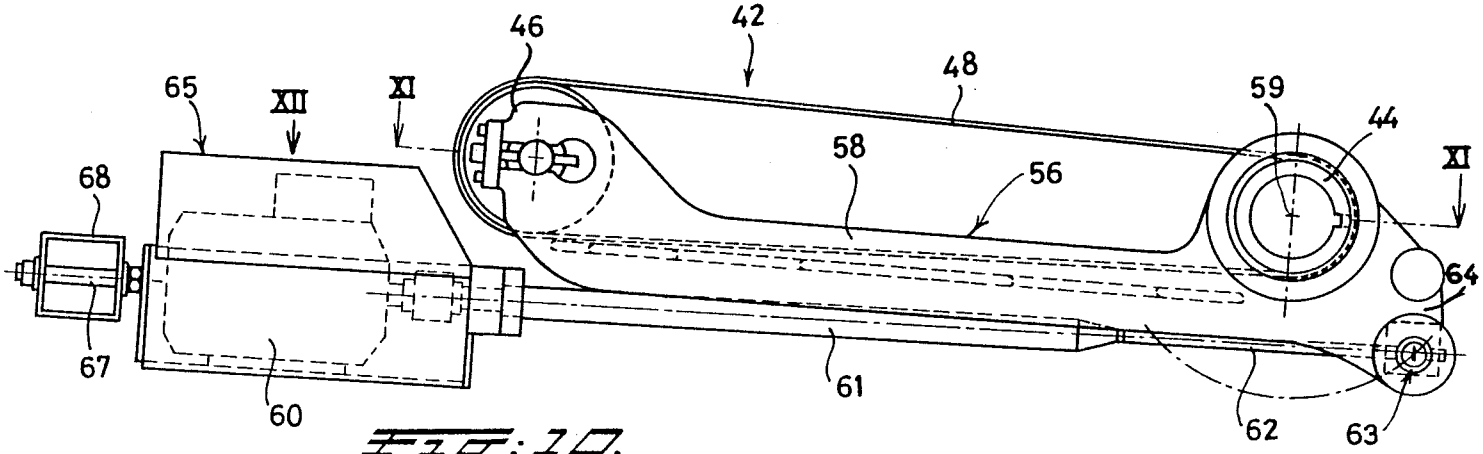
FIG. 10 shows the first driving belt unit for the unwinding roll, in side view and on an enlarged scale.

In FIGS. 10 and 11 it can be seen that the control roller 44 and the idler roller 46 of the first driving belt unit 42 are mounted in a frame 56, comprising two parallel, connected plates 57 and 58. The driving belt unit 42 can be swung about the axis 59 of the driving roller 44. The swing movement is produced by a lead screw 62 driven by a motor 60 via an intermediate shaft 61. The lead screw 62 cooperates with a nut construction 63 which is hingedly mounted in an extension piece 64 of the frame 56 of the driving belt unit 42. The driving belt unit 42 can be swung about the axis 59 by turning the lead screw 62. The housing 65 in which the motor 60 is mounted can be moved in the axial direction of the lead screw 62 along guide rods 66 and 67 which are fixed by means of a bar 68 to the frame of the device (see FIGS. 10 and 12). The housing 65 is pressed in the direction of the bar 68 by means of springs 69. This construction has the following purpose. When the driving belt unit 42 moves upwards through the running of the motor 60 and consequently turning of the lead screw 62, and at a certain point the belt 48 comes to rest against the periphery of an unwinding roll, on further running of the motor the housing 65 of the motor will move to the right against the spring force of the springs 69 over the guide rods 66 and 67 in FIG. 12. As a result, the tensile force exerted by the lead screw 62 on the driving belt unit 42, and consequently the pressure of the belt 48 against the periphery of the roll, will increase. By making the motor 60 stop at a particular position of the housing relative to the guide rods 66 and 67, the pressure of the driving belt 48 against the periphery of the unwinding roll can be set.

Figure 13:
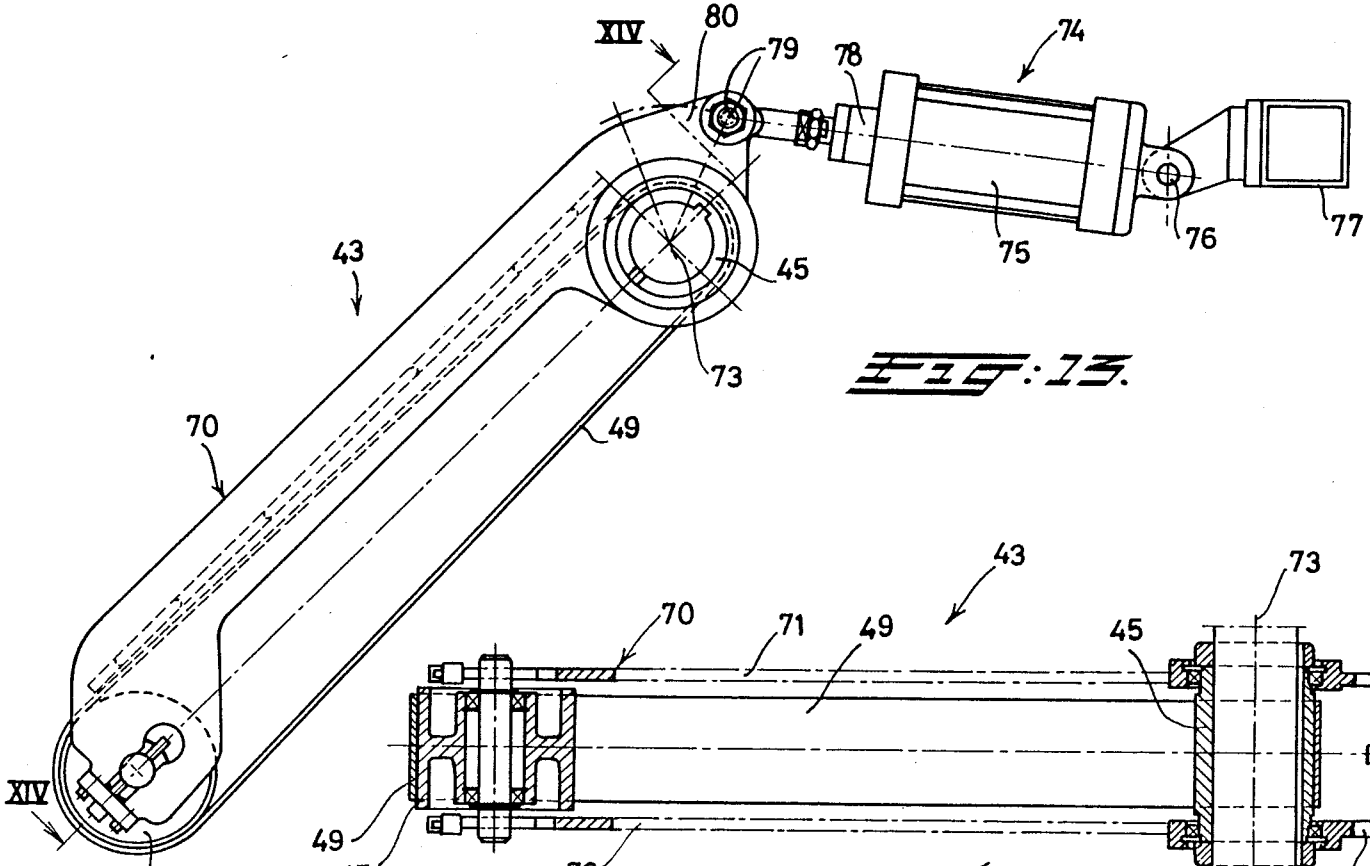
FIG. 13 shows the second driving belt unit for the unwinding roll, in side view and on an enlarged scale.
Figure 14:
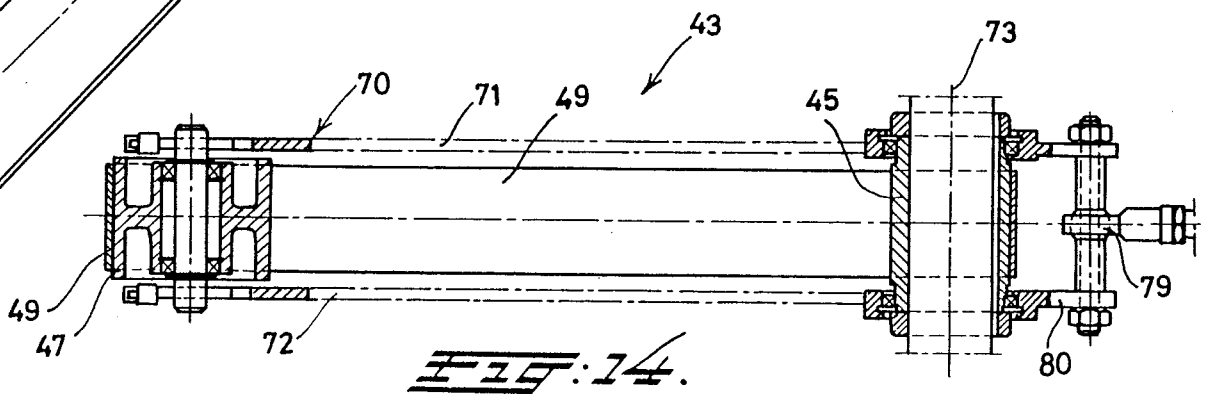
FIG. 14 is a view along the line XIV—XIV in FIG. 13.

It can be seen from FIGS. 13 and 14 that, as in the case of the first driving belt unit, in the second driving belt unit the control roller 45 and the idler roller 47 are rotatably mounted in a frame 70, which is formed by two parallel, connected plates 71 and 72. The second driving belt unit 43 can swing about an axis 73. The swing movement is obtained by means of a piston/cylinder combination 74. The piston 75 is connected by means of a hinge 76 and a bar 77 to the frame of the device. The piston rod 78 of the piston moving in the cylinder 75 is connected by means of a hinge 79 to an extension piece 80 of the frame 70 of the second driving belt unit 43. Through operation of the piston/cylinder combination 74, the second driving belt unit 43 can be swung about the axis 73. The force with which the belt 49 can be pressed against an unwinding roll is determined by the pressure in the cylinder 75.

Figure 16:
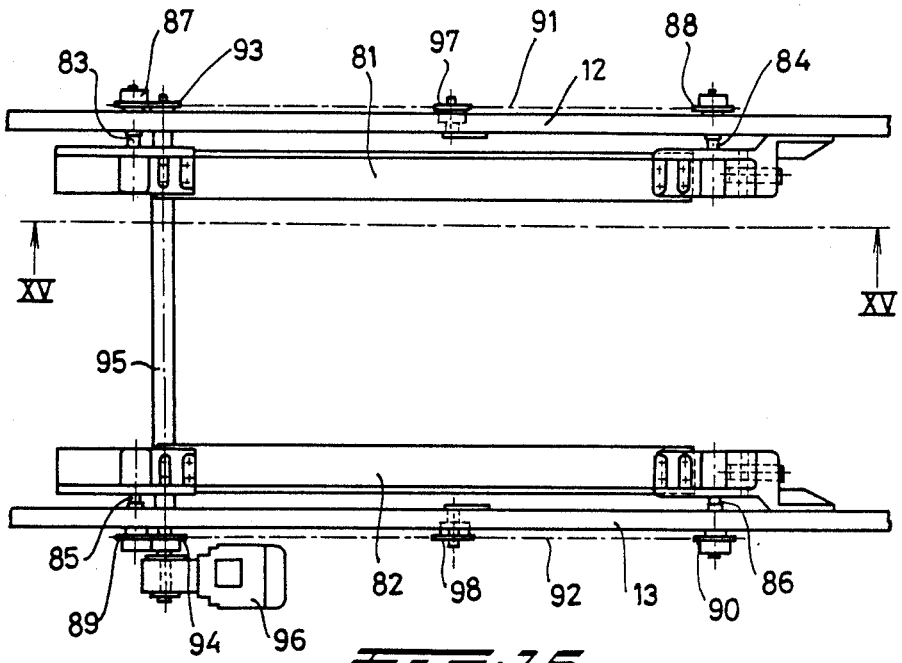
FIG. 16 is a top view of the drive of the transverse adjustment of the shafts of the unwinding roll and the new roll.
Figure 15:
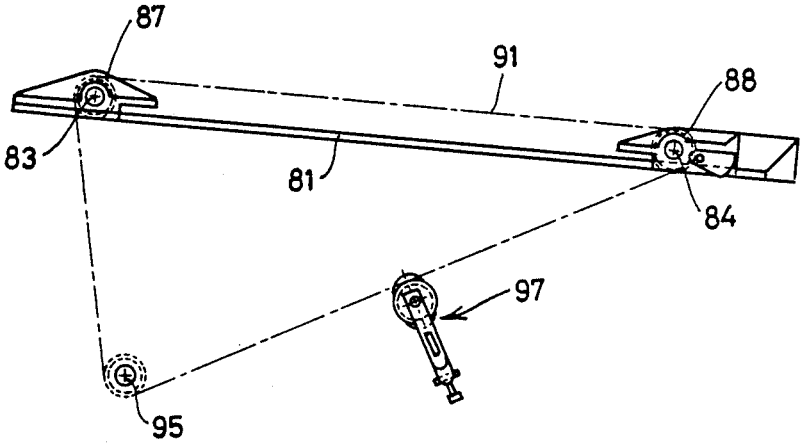
FIG. 15 shows the drive for the transverse adjustment of the shafts of the unwinding roll and the new roll, in a view along the line XV—XV in FIG. 16.

FIGS. 15 and 16 show the device for shifting across the frame 1 a shaft of an unwinding roll guided along the top part 16 of the guide tracks 14 and 15 and a shaft of a new roll lying in the seat 22 of the guide tracks 14 and 15. This device comprises two side guides 81 and 82 which are provided on either side of the shafts, and which can be moved across the frame at the same time and in the same direction. This movement is achieved by turning lead screws 83, 84, 85 and 86 which are screwed into the guides at the ends of the guides 81 and 82, and which are rotatably mounted in the mounting plates 12 and 13. The turning of the lead screws 84 to 86 is brought about by means of chains 91 and 92 running around sprocket wheels 87, 88, 89 and 90 mounted on the lead screws. The chains 91 and 92 also run over sprocket wheels 93 and 94 which are driven via a shaft 95 by a motor 96. Through the running of the motor 96, the lead screws 83 to 86 are turned at the same time, so that the two side guides 81 and 82 move simultaneously in the same direction. A tensioning device 97, 98 is fitted for each chain 91, 92.

Figure 17:
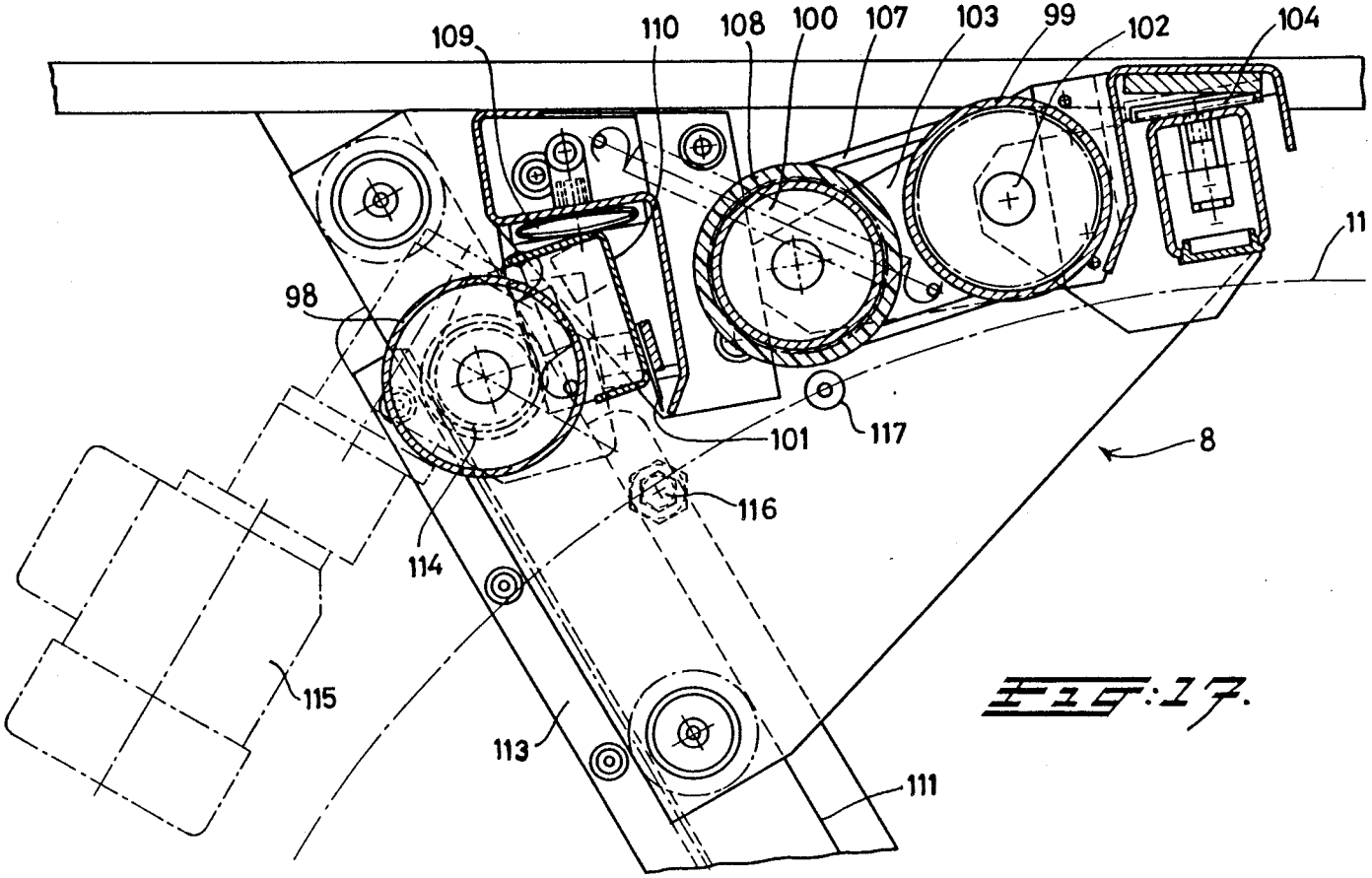
FIG. 17 shows the web splicing unit on an enlarged scale, in a view along the line XVII—XVII in FIG. 18.
Figure 18:
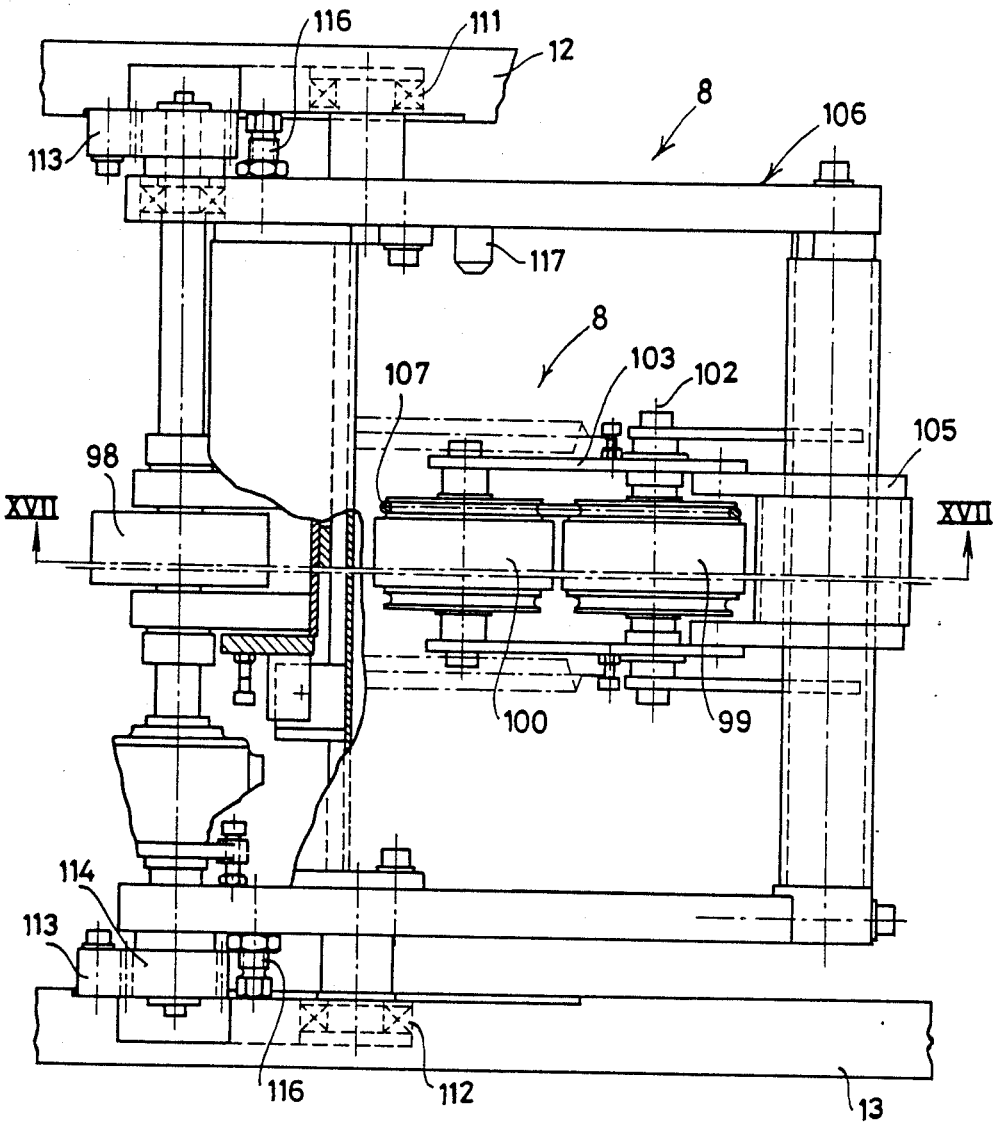
FIG. 18 is a top view of the web splicing unit of FIG. 17.
Figure 15:
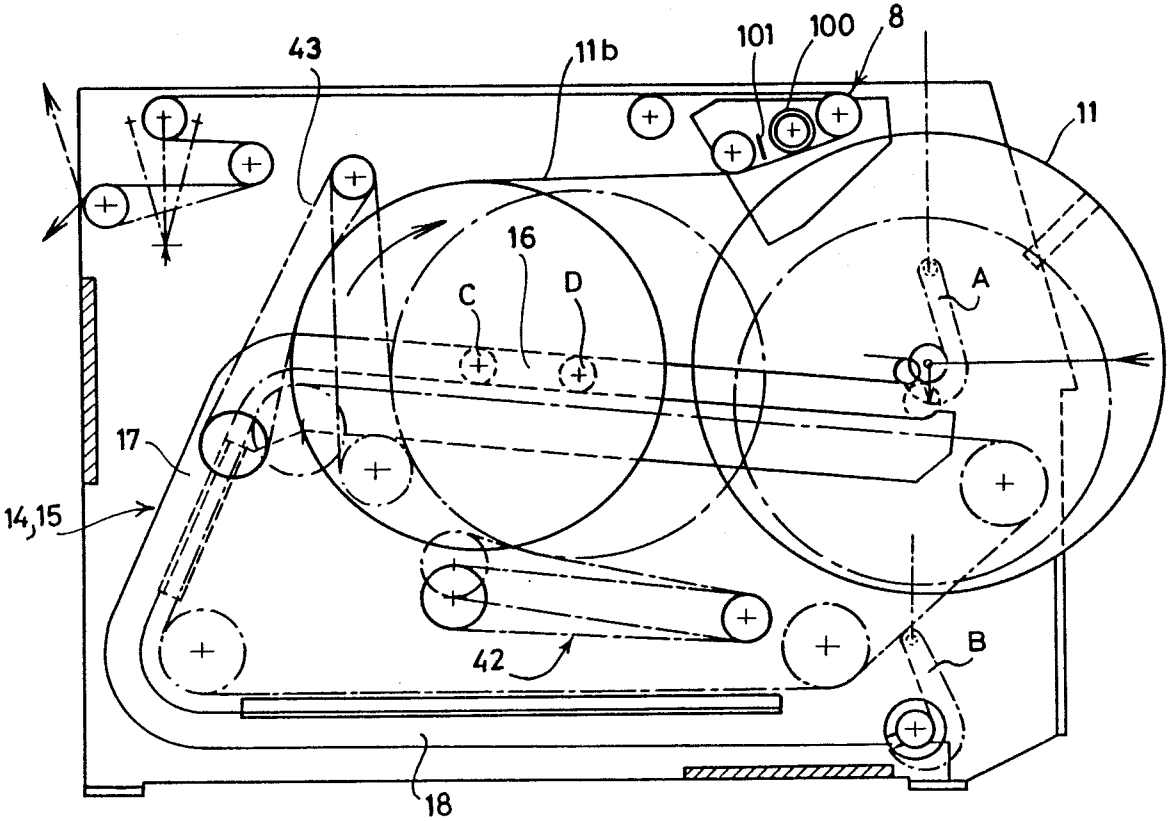

FIGS. 17 and 18 show the web splicing unit 8 on an enlarged scale. This web splicing unit 8 comprises a guide roller 98 and a reversing roller 99 for the web of material. The two rollers 98 and 99 extend in a direction perpendicular to the direction of movement of the web of material. A pressure roller 100 is provided between the two rollers 98 and 99, parallel thereto. The pressure roller 100 is for pressing the unwinding web of material against the new roll 11. A cutter 101 is also provided between the two rollers 98 and 99, extending parallel to the two rollers and being movable towards the roll 11. The cutter 101 is for severing the unwinding web of material. The pressure roller 100 is rotatably mounted in a yoke 103 which tilts about the axis of rotation 102 of the reversing roller 99. This yoke is tiltable by means of a flexible tubular cylinder 104 which operates between an extension piece 105 of the yoke 103 and the frame 106 of the web splicing unit 8. The pressure roller 100 and the reversing roller 99 are connected together by means of a belt 107, so that the pressure roller 100 always rotates at the same speed as the reversing roller 99, which is driven by the advancing web of material. The pressure roller 100 is clad with a rubber coating 108. The cutter 101 is movable towards the web of material running along the web splicing unit by means of a flexible tubular cylinder 109 which operates between a movable cutter holder 110 and the frame 106 of the web splicing unit 8. The whole web splicing unit 8 can be moved in a straight line in the direction of the center of a new roll. The web splicing unit 8 is for this purpose mounted in straight groove-type guides 111 and 112 disposed in the mounting plates 12 and 13. The guides 111 and 112 are provided on one side with a geared rack 113 which mates with a gear wheel 114. The gear wheels 114 can be rotated by a motor 115. The web splicing unit 8 is also provided with positioning elements 116 which take care of lateral positioning of the web splicing unit. The web splicing unit 8 is provided with a detection element 117 for the detection of the outer periphery of a new roll 11. When the detection element passes the outer periphery of the roll during the movement of the web splicing unit 8 towards the center of the new roll, the motor 115 stops and the web splicing unit is at the minimum distance from the periphery of the new roll 11.

It will be clear that the above-described device is also provided with means for controlling the movements of the various parts. A microprocessor can be advantageously used for the control.

Figure 20:
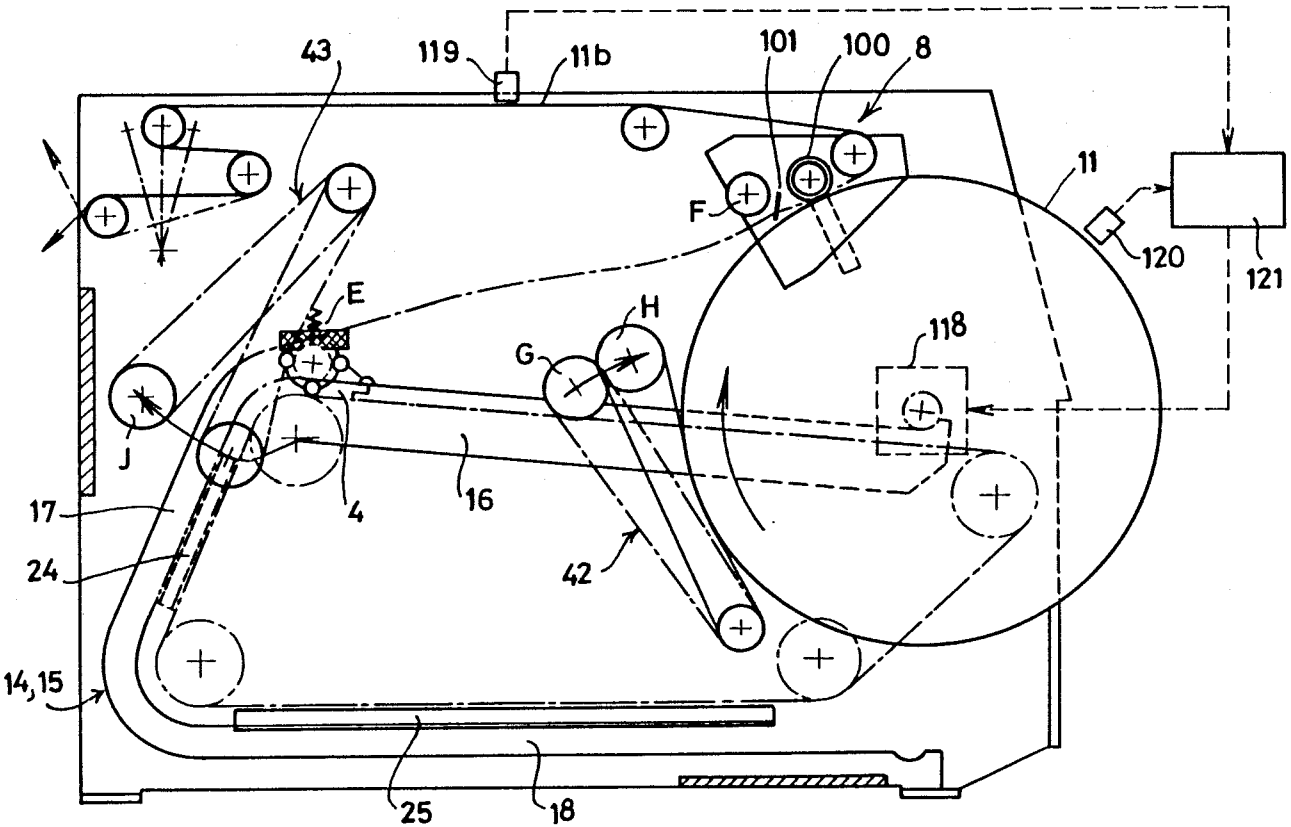
Figure 22:
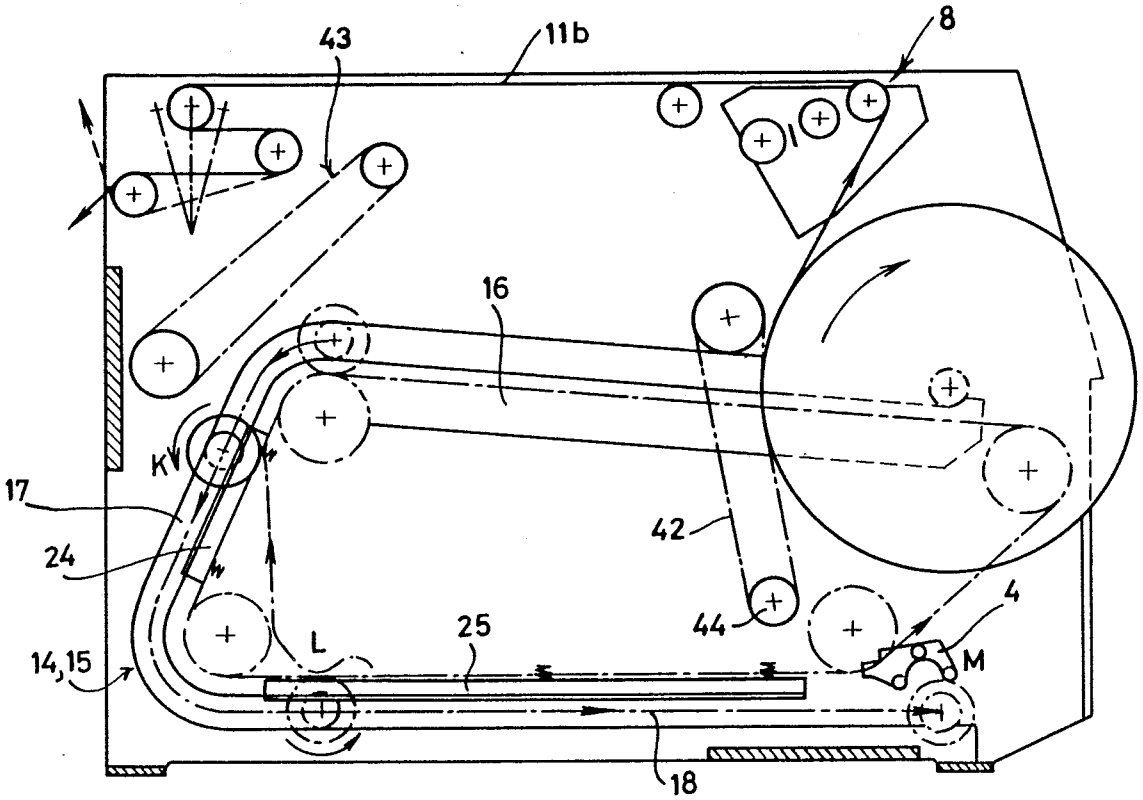

FIGS. 19–21 show schematically the various stages of unwinding of a web from an unwinding roll and the changing of a roll. In FIG. 19 a new roll is inserted at A. Immediately after a new roll has been inserted at A, a remnant roll lying there can be picked up at B. The insertion of a new roll and the removal of the remnant roll can take place when the unwinding roll is at position C. At position C the peripheral speed of the unwinding roll is controlled by the second driving belt unit 43. The first driving belt unit 42 is then free of the unwinding roll. At position D, at which the unwinding roll has been for some time previous, the control of the peripheral speed of the roll is taken over from the first driving belt unit 42 by the second driving belt unit 43. When the unwinding roll is controlled by the second driving belt unit 43, the position of the shaft of the unwinding roll on the guide tracks 14, 15 is controlled by the position of the second driving belt unit 43. When the latter moves to the right when the diameter of the roll in FIG. 19 becomes smaller, the shaft of the unwinding roll is moved to the left by the carrier 4. When the unwinding roll has reached its minimum diameter and is in the position E, as shown in FIG. 20, the following movements take place. By means of a core drive 118, the new roll is run up to and held at a peripheral speed equal to the speed of movement of the unwinding web (11*b*). The speed of the unwinding web 11*b* and the peripheral speed of the new roll 11 can be measured by common measuring device 119 and 120 respectively. A control device 121 coupled with these measuring devices and the core drive controls the rotational speed of the new roll (11, 11'). The web splicing unit 8 is moved to the new roll (position F) and the first driving belt unit is moved close up to the new roll, but without making contact with the new roll (position G). The unwinding web is now moved by the pressure roller 100 of the web splicing unit 8 against the prepared new roll, so that the leading end of the web of the new roll is adhered to the unwinding web. The cutter 101 of the web splicing unit 8 is also moved into the unwinding web, which is severed. Immediately afterwards, the core drive 118 of the new roll is switched off, and the first driving belt unit 42 moves to the new unwinding roll and handles the control of the peripheral speed thereof (position H). At the same time the second driving belt unit 43 is moved out of contact with the remnant roll (position J), and the remnant roll is slowed down. The remnant roll is then conveyed by the carrier 4 along the intermediate part 17 and the bottom part 18 of the guide tracks 14, 15, the presence of the friction elements 24, 25 causing the remnant roll to rotate, so that the loose-hanging end part of the web is wound onto the remnant roll (positions K and L). The remnant roll is conveyed by the carrier 4 to the end of the bottom part 18 of the guide tracks (position M). In the meantime, the new unwinding roll is partially unwound. When the diameter of this roll has reached such a value that the roll can pass the control roller 44 of the first driving belt unit 42, the carrier 4 takes the shaft of the unwinding roll out of the seat 22 at the end of the top part 16 of the guide tracks and conveys the roll over the guide tracks to the left in FIG. 21. During the conveyance of the unwinding roll the first driving belt unit 42 will swing downwards, and the situation shown in FIG. 19 will be reached again after some time has elapsed.

The device for the continuous feed of a web of material from the stock roll according to the invention has the following advantages, amongst others, over the known device:

simple placing of a new roll and removal of remnant roll possible, possibility of automation, uninterrupted splice between two successive webs over width of the web.

What is claimed is:

1. A device for continuously feeding a web of material from a roll, comprising a frame, means for rotatably supporting an unwinding roll which is present in the device and off which the web of material is coming, means for rotatably supporting a new stock roll placed in the device, means for controlling the peripheral speed of the unwinding roll, means for driving the new roll, means for adhering the leading end of the web on the new roll to the unwinding web coming off the unwinding roll and severing the unwinding web after the splicing point, conveyor means for conveying through the device the unwinding roll and the remnant roll, i.e., the remaining part of the unwinding roll which is left after the web coming from said roll is severed, said conveyor means comprising two parallel guide tracks each disposed on one of the two long sides of the frame, for guiding the ends of a shaft bearing a roll, and two flexible endless conveyor elements each running along one of the two guide track assemblies, each guide track having essentially a U-shape, viewed from the side of the device, and comprising a top part extending essentially horizontally in the lengthwise direction of the device from the front of the device towards the rear thereof, for guiding the ends of the shaft of the unwinding roll during unwinding, an intermediate part connecting to the rear end of the top part and extending downward, and a bottom part connecting to the bottom end of the intermediate part and extending essentially horizontally in the lengthwise direction of the device toward the front thereof, the intermediate part and the bottom part serving to guide the ends of the shaft of the remnant roll out of the device, and each conveyor element being provided with at least one carrier element for carrying one end of the shaft of a roll along the associated guide track assembly, and elongated friction elements provided in the region of the intermediate part and/or the bottom part of the guide tracks and running parallel thereto, said friction elements being designed to cooperate with the shaft of the remnant roll to make this remnant rotate for the purpose of rolling the loose end part of the severed web onto the remnant roll.

2. The device of claim 1, wherein the top parts of the two guide tracks near the free end at the front of the device are provided with a seat for receiving the ends of the shaft of a new roll.

3. A device for continuously feeding a web of material from a roll, comprising a frame, means for rotatably supporting an unwinding roll which is present in the device and off which the web of material is coming, means for rotatably supporting a new stock roll placed in the device, means for controlling the peripheral speed of the unwinding roll, means for driving the new roll, and means for adhering the leading end of the web on the new roll to the unwinding web coming off the unwinding roll and severing the unwinding web after the splicing point, and conveyor means for conveying through the device the unwinding roll and the remnant roll, i.e., the remaining part of the unwinding roll which is left after the web coming from said roll is severed, said means for controlling the peripheral speed of the unwinding roll comprising two driving belt units designed to cooperate with the periphery of the unwinding roll, after one another, in such a way that the first driving belt unit controls the peripheral speed of the unwinding roll during the first part of the unwinding period from the moment that the leading end of the web on said roll is connected to the unwinding web coming off the previous unwinding roll, and the second driving belt unit controls the peripheral speed of the unwinding roll during the second part of the unwinding period up to the moment that the leading end of the web on the new roll is spliced to the unwinding web and the unwinding web is severed, each driving belt unit comprising at least a flat belt running round a control roller and an idler roller mounted in the frame of the unit and being designed to swing about an axis coinciding with the axis of the control roller, in such a way that each flat belt can be brought separately into and out of contact with the periphery of the unwinding roll, the speed of rotation of the control rollers of the two driving belt units and thus the peripheral speed of the driving belts being controlled by a common endless belt which cooperates with the control rollers and whose peripheral speed is controlled by a motor.

4. The device of claim 3, wherein the first driving belt unit is coupled with a motor-driven lead screw for swinging said first driving belt unit.

5. The device of claim 3, wherein the second driving belt unit is coupled with a piston/cylinder combination for swinging the second driving belt unit.

6. The device of claim 3, wherein the means for driving the new roll comprise a core drive designed to act upon the shaft of the new roll and being capable of working independently of the means for controlling the peripheral speed of the unwinding roll, the device being provided with means for measuring the peripheral speed of the new roll and the speed of the unwinding web, and control means coupled to the means for measuring the speed of the new roll and the speed of the unwinding web and to the core drive for the new roll, for controlling the peripheral speed of the new roll, in order to make this peripheral speed the same as the speed of the unwinding web.

7. A device for continuously feeding a web of material from a stock roll, comprising a frame, means for rotatably supporting an unwinding roll which is present in the device and off which the web of material is coming, means for rotatably supporting a new stock roll placed in the device, means for controlling the peripheral speed of the unwinding roll, means for driving the new roll, a web splicing unit for adhering the leading end of the web on the new roll to the unwinding web coming off the unwinding roll and severing the unwinding web after the splicing point, and conveyor means for conveying through the device the unwinding roll and the remnant roll, i.e., the remaining part of the unwinding roll which is left after the web coming from said roll is severed, said web splicing unit being movable in a straight line in the direction of the center of the new roll and comprising a guide roller and reversing roller for the unwinding web, said guide roller and reversing roller being disposed in the direction of movement of the unwinding web at a distance from each other and extending at right angles to the direction of movement of the unwinding web, a pressure roller disposed between the guide roller and the reversing roller and extending parallel thereto, for pressing the unwinding web against the periphery of the new roll, said pressure roller being rotatably mounted in a yoke which is tiltable about the axis of rotation of the reversing roller by means of a flat flexible tubular cylinder running in the lengthwise direction of the pressure roller, a cutter for severing the unwinding web, said cutter also being disposed between the guide roller and the reversing roller and extending parallel thereto, and being movable toward the unwinding web by means of a flat flexible tubular cylinder running in the lengthwise direction of the cutter, and a detection element for detecting the outer periphery of the new roll.

* * * * *